US012042851B2

(12) United States Patent
Leung et al.

(10) Patent No.: US 12,042,851 B2
(45) Date of Patent: Jul. 23, 2024

(54) CASTING METHOD AND ASSOCIATED DEVICE

(71) Applicant: ArcelorMittal, Luxembourg (LU)

(72) Inventors: Jackie Leung, Hamilton (CA); Stephen Daeyoung Chung, Mississauga (CA); Joydeep Sengupta, Hamilton (CA); Tim Rayner, Oakville (CA)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 18/265,907

(22) PCT Filed: Dec. 15, 2020

(86) PCT No.: PCT/IB2020/061922
§ 371 (c)(1),
(2) Date: Jun. 7, 2023

(87) PCT Pub. No.: WO2022/129984
PCT Pub. Date: Jun. 23, 2022

(65) Prior Publication Data

US 2024/0033814 A1 Feb. 1, 2024

(51) Int. Cl.

| | |
|---|---|
| ***B22D 11/16*** | (2006.01) |
| ***B22D 2/00*** | (2006.01) |
| ***B22D 11/04*** | (2006.01) |
| ***B22D 11/108*** | (2006.01) |
| ***B22D 11/18*** | (2006.01) |
| ***B22D 11/20*** | (2006.01) |
| ***B22D 46/00*** | (2006.01) |

(52) U.S. Cl.
CPC ..... *B22D 11/165* (2013.01); *B22D 2/001* (2013.01); *B22D 11/04* (2013.01); *B22D 11/108* (2013.01); *B22D 11/185* (2013.01); *B22D 11/204* (2013.01); *B22D 46/00* (2013.01)

(58) Field of Classification Search
CPC ..... B22D 11/165; B22D 11/04; B22D 11/108; B22D 11/185; B22D 11/204; B22D 2/001; B22D 46/00
See application file for complete search history.

(56) References Cited

U.S. PATENT DOCUMENTS

2004/0187641 A1 9/2004 Kemeny et al.

OTHER PUBLICATIONS

Search Report of PCT/IB2020/061922 of Jun. 14, 2021 and International Report on Patentability.
Konar Bikram et al, "Tundish Open Eye Formation: Integrated Troubleshooting Using Computational Modeling, Physical Modeling, and Plant Trials", AISTECH 2019; Proceedings of the Iron & Steel Technology Conference, May 2019—(May 9, 2019).

*Primary Examiner* — Kevin P Kerns
*Assistant Examiner* — Steven S Ha
(74) *Attorney, Agent, or Firm* — Davidson Kappel LLC

(57) ABSTRACT

A method of casting a steel semi-product wherein a liquid steel is poured from a ladle to a tundish through a shroud including the steps of determining the light intensity emitted from the surface of the liquid steel in the tundish, detecting, based on said determined intensity, the presence of an open-eye at the surface of the liquid steel and emitting an alert towards an operator when an open-eye is detected.

8 Claims, 3 Drawing Sheets

CASTING METHOD AND ASSOCIATED DEVICE

BACKGROUND

In the casting of steel semi-finished products, a liquid steel is poured into a mould through a Submerged Entry Nozzle (SEN) and then slowly cooled down until it solidifies and turns into a semi-finished product, such as a steel slab or billet. Liquid steel is manufactured to a given composition and temperature in a ladle and then poured into a tundish through a ladle shroud. An inert gas is injected into the shroud to protect liquid steel from a possible air entry when the shroud is inserted into the ladle. The tundish is used to feed the liquid steel into the ingot mould, it acts as a reservoir and a buffer of liquid steel to feed the casting machine to provide a smooth out flow and regulate said flow.

The surface of liquid steel in the tundish is covered by a floating tundish powder layer. An aim of this powder is to avoid liquid steel to be in contact with outside air and oxidize. For several reasons, such as fluctuations in the flow of liquid steel or creation of bubbles by the inert gas, the powder layer may not be continuous, and some opened areas may appear: they are called Tundish Open Eye (TOE) or tundish roll.

The main consequence of the presence of an open-eye is that liquid steel is exposed to the air in this region. As a result, re-oxidation of liquid steel happens, and inclusions are formed. This is detrimental to the steel cleanliness and may cause defects in the solidified product. Moreover, inclusions may flow towards the SEN and agglomerate until causing the clogging of the SEN. When an SEN is clogged, resulting steel semi-products have to be discarded for quality issues and the whole casting process is slowed down to replace the clogged SEN. This is thus detrimental to both product quality and productivity.

SUMMARY OF THE INVENTION

The open-eye phenomenon and its consequences are known, that's why in current practice an operator is in charge of regularly inspecting the surface of the liquid steel in the tundish and adding powder when necessary. However, this method, as with any human-based method, has its limitations. As the operator is not watching continuously the surface there is always a delay between the formation of the open eye and the powder addition, depending on the sensitivity of the steel grade, and even a small delay may have a detrimental impact on the quality of the steel produced. Moreover, accumulation of small periods of oxidation will lead to accumulation of inclusions and clogging of the SEN.

There is so a need for a method allowing to accurately detect formation of open-eye on the surface of liquid steel in a tundish. There is also a need for a method allowing to improve the quality of the cast semi-product and improve lifetime of Submerged Entry Nozzles.

The present invention provides a method comprising the steps of determining the light intensity emitted from the surface of the liquid steel in the tundish, detecting, based on said determined intensity, the presence of an open-eye at the surface of the liquid steel and emitting an alert towards an operator when an open-eye is detected.

The method of the invention may also comprise the following optional characteristics considered separately or according to all possible technical combinations:

- between determination and detection steps, the method includes a step of calculating, based on the determined intensity, the size of the open eye,
- the emission step is performed only if calculated size of the open eye is superior or equal to a predetermined threshold size,
- after the alert emission step, the method comprises a step of pouring powder to the surface of the liquid steel in the tundish,
- the calculation step is performed using a regression model,
- the determination step is performed using a baseline of intensity representative of a steel surface without open eye.

The invention is also related to a casting equipment comprising a ladle, a tundish, a mold and an open-eye alert device comprising a measuring device able to capture data representative of a light intensity, and being located so as to be able to capture light emitted from the tundish surface, a processor able to receive said captured data representative of a light intensity and comprising determination means able to determine the light intensity emitted from the surface of the liquid steel in the tundish, detection means able to detect presence of an open-eye at the surface of the liquid steel, based on said determined intensity, alert emission means able to emit an alert towards an operator when an open-eye is detected.

The measuring device may be a light transmitter.

BRIEF DESCRIPTION OF THE DRAWINGS

Other characteristics and advantages of the invention will emerge clearly from the description of it that is given below by way of an indication and which is in no way restrictive, with reference to the appended figures in which.

DETAILED DESCRIPTION

Elements in the figures are illustration and may not have been drawn to scale.

Figure 1:
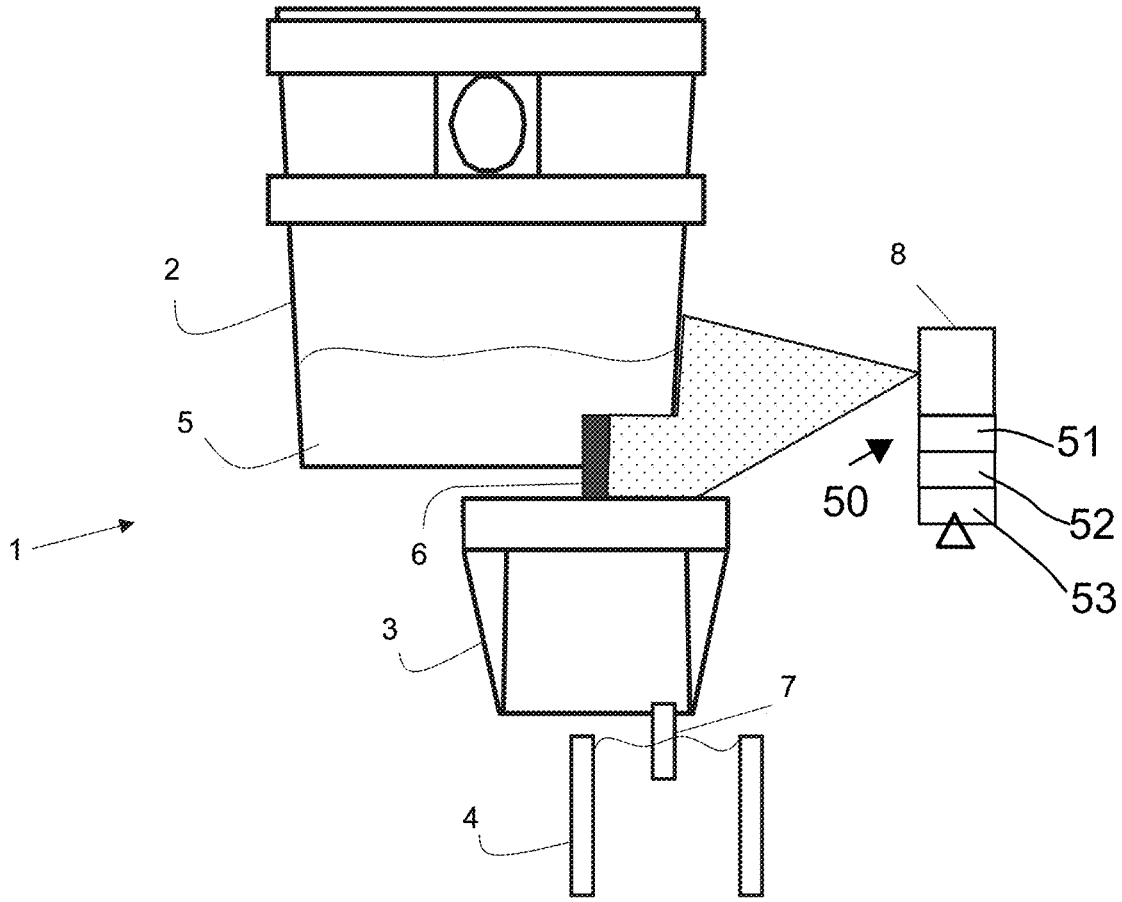
FIG. 1 illustrates a casting equipment provided with a device to implement a method according to the invention.

FIG. 1 illustrates a casting equipment 1 comprising a ladle 2, a tundish 3 and a mould 4. Liquid steel 5 in the ladle 2 has the required temperature and composition according to the steel semi-finished product to be cast. It first flows from the ladle 2 to the tundish 3 through a ladle shroud 6 and then from the tundish 3 to the mould 4 through a Submerged Entry Nozzle (SEN) 7. The liquid steel then flows slowly out of the mould 4 and solidifies to form the semi-finished product.

Figure 2A:
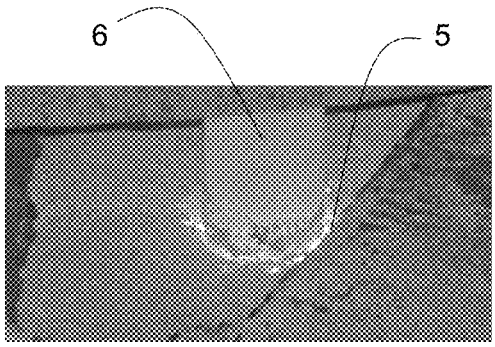
FIGS. 2A and 2B are images of a liquid steel layer in a tundish.
Figure 2B:
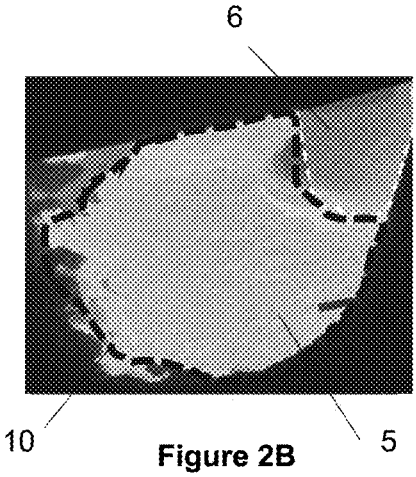

FIGS. 2A and 2B are real images of liquid steel surface covered with tundish powder in a tundish 3. On FIG. 2A there is no open eye, the powder layer is continuous and homogeneous, and liquid steel 5 can be guessed just under the ladle shroud 6. On the opposite, on FIG. 2B formation of big open-eye 10 around the ladle shroud 6 can be seen. The aim of the figures is to illustrate that size of a TOE (Tundish Open-Eye) can be large and thus a large quantity of steel surface is in contact with air and can be re-oxidized. That's why it is important to detect formation of such open-eye at an early stage to limit its consequences.

Figure 3:
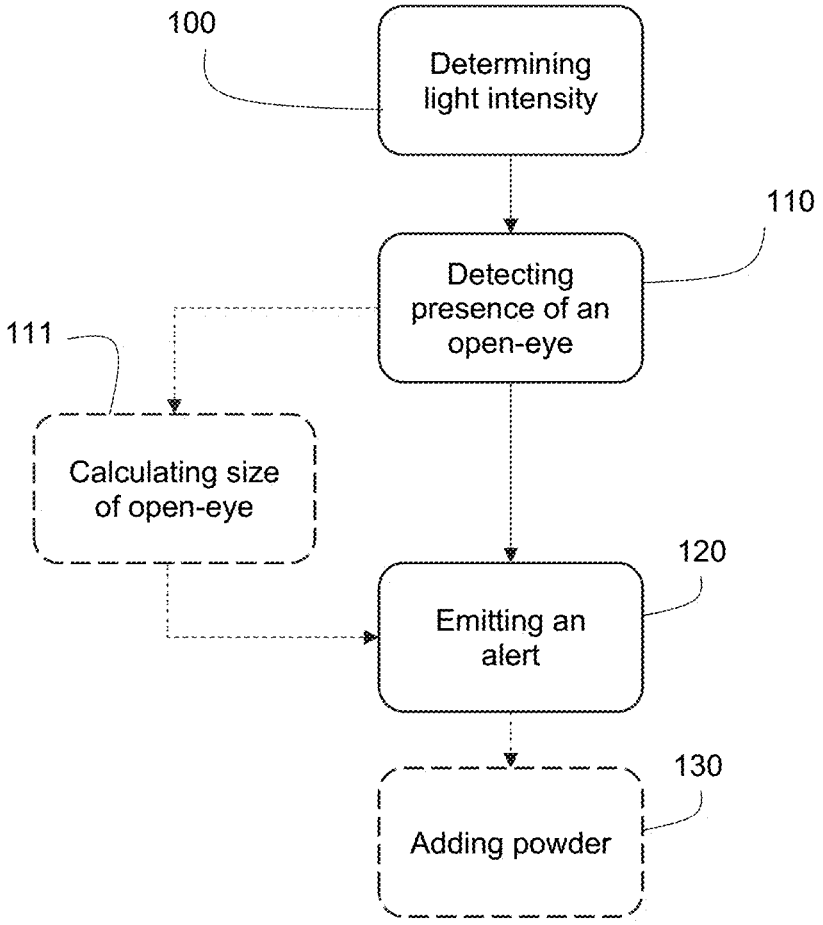
FIG. 3 is a flowchart of a method according to the invention.

FIG. 3 is a flow chart of a method according to the invention. In a first step 100 the light intensity emitted from the surface of the liquid steel in the tundish is determined. This step can be performed by using any sensor able to measure either directly, or indirectly, a light intensity. The sensor may for example be a light sensor, which measures a light intensity, like light sensor 8. This light sensor 8 may be any kind of sensor allowing to measure a light intensity. It is preferable to use a light intensity transmitter such as BLUX510 from BASI Instruments. An advantage of using such a transmitter is that it is a simple device which can be easily protected to withstand the high temperature environment surrounding the tundish.

As shown in FIG. 1 the sensor 8 may measure light intensity around the tundish and the signal measured is then treated to remove all the components which are not linked to the liquid steel surface. For example, the ladle shroud, which is made of refractories, heats when the liquid steel flows through and turns red. It is thus really bright, and it may be required to remove this light intensity component from the signal captured by the sensor to keep only signal relative to the steel surface.

In a second step 110, the presence of an open-eye at the surface of the liquid steel is detected based on the previously determined intensity. This can be performed for example by determining a baseline of intensity representative of continuous layer of power, without open-eye. If the determined light intensity is above this baseline, it means that an open-eye is present.

After this second step 110, an optional step 111 may be performed which consists in calculating the size of the detected open-eye. To do so a regression model can be used. This regression model is built by correlating open eye size, measured through direct observation, to respective light intensity signal for multiple open eyes of various size. As a result, size of future open eyes can be predicted using said model.

Figure 5:
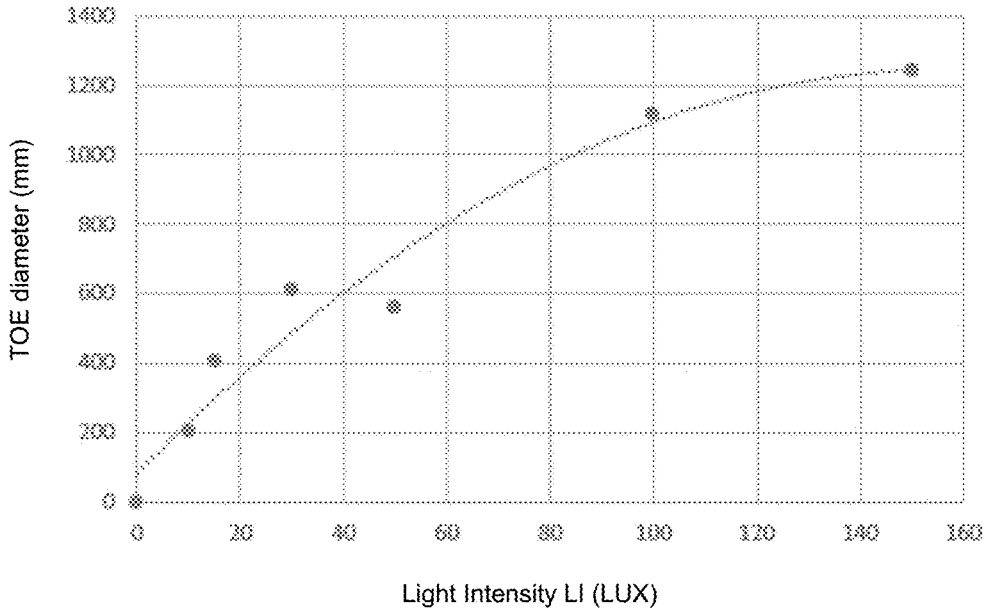
FIG. 5 is a curve representing TOE size in function of measured light intensity

FIG. 5 is a curve representing TOE size in function of measured light intensity. this king of curve may be used in the calculation step 111 to determine the size of the TOE.

After the second detection step 110 or the optional calculation step 111, the third step 120 is performed which consists in emitting an alert towards an operator when an open-eye is detected (see FIG. 3). Optionally this alert may be emitted only when the calculated size of the open-eye is above a predetermined threshold. For a tundish having a length of nine meters, the alert is for example emitted only when the size is superior or equal to 90 centimetres.

Determination 100, detection 110, alert emission 120, calculation 111 steps are preferentially performed by at least one processor 50 with a determinator 51, detector 52 and signal emitter 53, all shown schematically in FIG. 1, provided with a dedicated algorithm able to perform all of said steps.

When an alert is emitted in step 120, tundish powder is poured on the surface of the steel to cover the open-eye. This may be done either by an operator or through an automatic pouring device receiving instructions from the operator or directly by a processor performing the detection and/or the calculation steps.

Figure 4:
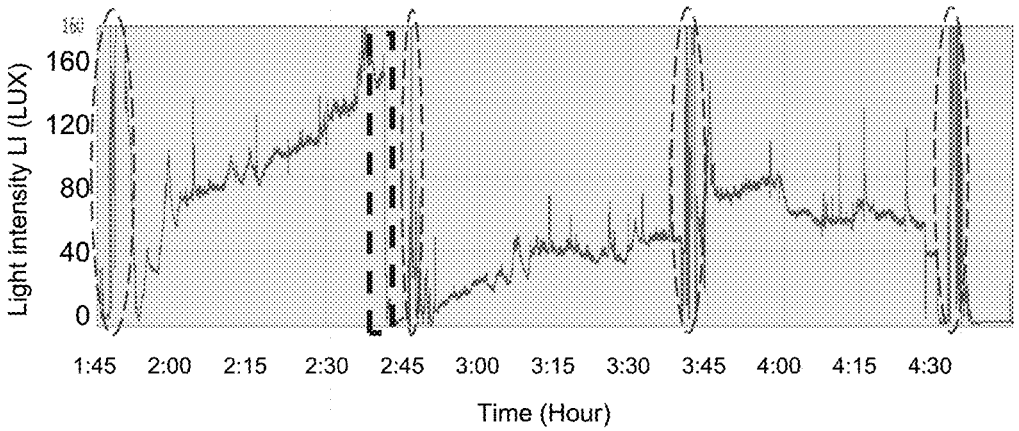
FIG. 4 is a curve representing light intensity in function of time during a casting campaign

FIG. 4 is a curve representing light intensity expressed in Lux vs time as measured during a casting campaign using a casting method according to the invention. Sensor used to measure light intensity is BLUX510 light transmitter from BASI Instruments. Each circled peak is representative of the beginning of a new heat, corresponding to the pouring of steel into the tundish through the ladle shroud. At each heat start, the ladle and ladle shroud are lifted to exchange an empty ladle with a full one. This in turns increase the overall area brightness which corresponds to the peak of intensity. After ladles are exchanged, the ladle and ladle shroud are lowered. Then, it can be seen that light intensity is almost null and increase, more or less rapidly, depending on the considered heat. This corresponds to the appearance and growing of an open-eye on the surface of the steel. This was visually checked during the trial. During the first heat, the size of the open-eye exceeded a predetermined threshold and powder had to be added, which can be noticed on the curve with the sudden decrease highlighted in bold rectangle.

With the method according to the invention it is possible to detect tundish open-eyes and alert quickly an operator so as to reduce impacts on product quality and equipment duration.

What is claimed is:

1. A method of casting a steel semi-product comprising:
- pouring a liquid steel from a ladle to a tundish through a shroud;
- determining a light intensity emitted from a surface of the liquid steel in the tundish;
- detecting, based on the determined intensity, the presence of an open-eye at the surface of the liquid steel; and
- emitting an alert towards an operator when an open-eye is detected.

2. The method as recited in claim 1 further comprising, between the determination and detection steps, a step of calculating, based on the determined intensity, a size of the open-eye.

3. The method as recited in claim 2 wherein the emitting step is performed only if the calculated size of the open-eye is superior or equal to a predetermined threshold size.

4. The method as recited in claim 2 wherein the calculation step is performed using a regression model.

5. The method as recited in claim 1 further comprising, after the emitting step, a step of pouring powder to the surface of the liquid steel in the tundish.

6. The method as recited in claim 1 wherein the determination step is performed using a baseline of intensity representative of a steel surface without open eye.

7. A casting equipment with an open-eye alerter configured to implement the method as recited in claim 1; comprising:
- a ladle;
- a tundish;
- a mold;
- a measurer configured to capture data representative of a light intensity, the measurer being located so as to be able to capture light emitted from a surface in the tundish; and
- a processor configured to receive the captured data representative of the light intensity and comprising:
  - i. a determinator configured to determine the light intensity emitted from the surface of the liquid steel in the tundish,
  - ii. a detector configured to detect presence of an open-eye at the surface of the liquid steel, based on said determined intensity, and
  - iii. an alert emitter configured to emit an alert towards an operator when the open-eye is detected.

8. The casting equipment as recited in claim 7 wherein the measurer is a light transmitter.

* * * * *